US006137227A

United States Patent [19]

Kim et al.

[11] Patent Number: 6,137,227

[45] Date of Patent: Oct. 24, 2000

[54] PLASMA DISPLAY PANEL

[75] Inventors: Ho Jung Kim, Seoul; Hong Kyun Sohn, Ich'on; Deuk Soo Pyun, Seoul, all of Rep. of Korea

[73] Assignee: Hyundai Electronics Industries Co., Ltd., Kyoungki-do, Rep. of Korea

[21] Appl. No.: 09/103,750

[22] Filed: Jun. 24, 1998

[30] Foreign Application Priority Data

Jun. 25, 1997 [KR] Rep. of Korea ..... 97-27400

[51] Int. Cl.[7] ..... H01J 17/49

[52] U.S. Cl. ..... 313/582; 313/491; 313/634

[58] Field of Search ..... 313/582, 491, 313/634

[56] References Cited

U.S. PATENT DOCUMENTS

| | | | |
|---|---|---|---|
| 4,737,686 | 4/1998 | Harvey | 313/584 |
| 5,116,704 | 5/1992 | Kwon | 430/3 |
| 5,247,227 | 9/1993 | Park | 313/584 |

FOREIGN PATENT DOCUMENTS 62-283531 12/1987 Japan .

*Primary Examiner*—Vip Patel

*Attorney, Agent, or Firm*—Selitto & Associates

[57] ABSTRACT

A plasma display panel for preventing a discharging operation in a non-displaying area and thus progressing the contrast ratio according to the present invention is disclosed. The plasma display panel comprises a first substrate and a second substrate which are provided with each of inner faces opposite to each other. Between the first and second substrates, barrier ribs arranged toward a first direction are separated parallel to each other with a space. On the inner face of the first substrate, first electrodes are arranged parallel with each other toward a second direction which is orthogonal with the first direction. In addition, dot type second electrodes, which are connected with a pair of first electrodes and are exposed to a space between the pair of first electrodes, are arranged on the inner face of the first substrate. Between the barrier ribs on the inner face of the second substrate, there are placed third electrodes which are arranged parallel with the first direction. Here, a unit cell is defined as an area which is limited by the barrier ribs and includes a pair of first electrode.

7 Claims, 3 Drawing Sheets

PLASMA DISPLAY PANEL

BACKGROUND OF THE INVENTION

1. Field of the Invention

The present invention relates to a display, and more particularly, to a plasma display panel which is provided with a dot type transparent electrode.

2. Description of the Related Art

A Plasma Display Panel(PDP), as a kind of flat display, is a display which drives independently each of cells with a gas discharge, thereby displaying a desired image.

This PDP has the advantage of remarkably reducing its thickness and weight compared with an existing display using an electron gun, since a thickness between a front substrate and a rear substrate opposite to each other can be formed below about 10 cm. In addition, because a space between barrier ribs which separate each cell can be defined widely, it is possible that the size of screen can be made to be bigger than that of liquid crystal display(LCD). Moreover, the PDP has the advantage of improving a narrow visual angle which is the largest shortcoming in the LCD.

FIG. 1 shows a partial cross-sectional view of an alternating-current PDP(AC PDP) of a conventional art.

Referring to FIG. 1, a surface-discharge PDP comprises a first substrate or front substrate 4 and a second substrate or rear substrate 1 which are provided with each inner face opposite to each other, wherein the front substrate 4 means a substrate directed toward a screen at which a viewer looks. A barrier rib is located between the rear and front substrates 1, 4. The barrier rib defines a cell or unit pixel, and has a function of preventing a crosstalk among the pixels. On the rear substrate 1 of the unit pixel which is defined by the barrier ribs, there is placed an address electrode 2 which transfers an address signal to select the unit pixels perpendicular arranged to the drawing. A first dielectric layer 3 is positioned on the upper portion of the rear substrate 1 including the address electrode 2. Fluorescent material 10 which is selected out of red, blue, green ones is coated on the first dielectric layer 3 so as to be capable of materializing colors upon gas discharge. On the upper face of the front substrate 4 opposite to the inner face of the rear substrate 1, a discharge maintenance electrode in which a transparent electrode 5 and a data bus electrode 6 are stacked in order is placed. The transparent electrode 5 and data bus electrode 6 are arranged to be orthogonal with the arrangement direction of the barrier rib and have a stripe structure respectively. Furthermore, the data bus electrode 6 has a narrower width than that of the transparent electrode 5 (not shown), and is located on the upper portion of the transparent electrode 5. A second dielectric layer 7 and a protective layer 8 are stacked in order on the data bus electrode 6. As a result, the unit cell is defined by a pair of barrier ribs and a pair of data bus electrodes 6. A discharging space, which is defined by the protect layer 8, barrier rib 9 and fluorescent material 10, is filled with a gas 11 such as neon or xenon.

If an address signal for selecting the cell is supplied and a data signal is applied to the data bus electrode 6, the selected cells emit respectively a light by the gas discharge, whereby the PDP provided with such structure displays an image on the front substrate 4.

In order to progress a contrast ratio, as shown in FIG. 2, each of the discharging cells have to be divided into a displaying area and a non-displaying area in a plan view. However, the above mentioned PDP has a problem in that, since the discharging is also occurred in the non-displaying area upon the gas discharge for realizing the image, the entire contrast ratio is reduced. In order to solve the problem, there had been provided a method of forming the thickness of the dielectric layer to be thick, thereby restraining the gas discharge in the non-displaying area. However, there are also some problems in this method. That is, an additional process for forming the dielectric layer is necessary. And also, if the dielectric layer is coated on the non-displaying area, the discharging effect is reduced.

SUMMARY OF THE INVENTION

It is therefore an object of the present invention to prevent a gas discharge in the non-displaying area and thus a reduction in the contrast ratio.

According to the present invention, a PDP comprises various elements such as a first substrate and a second substrate which are provided with each of inner faces opposite to each other. Between the first and second substrates, barrier ribs arranged toward a first direction are separated parallel to each other with a space. On the inner face of the first substrate, first electrodes are arranged parallel with each other toward a second direction which is orthogonal with the first direction. In addition, dot type second electrodes, which are connected with a pair of first electrodes and are exposed to a space between the pair of first electrodes, are arranged on the inner face of the first substrate. Between the barrier ribs on the inner face of the second substrate, there are placed third electrodes which are arranged parallel with the first direction. Here, a unit cell is defined as an area which is limited by the barrier ribs and includes a pair of first electrodes.

According to the present invention, the above mentioned PDP forms a dot type transparent electrode within a discharging space of the unit cell, thereby preventing the gas discharge in the non-displaying area. As a result, the entire contrast ratio can be progressed.

DETAILED DESCRIPTION OF THE INVENTION

Hereinafter, preferred embodiments of the present invention will be explained in more detail with reference to the accompanying drawings.

Figure 1:
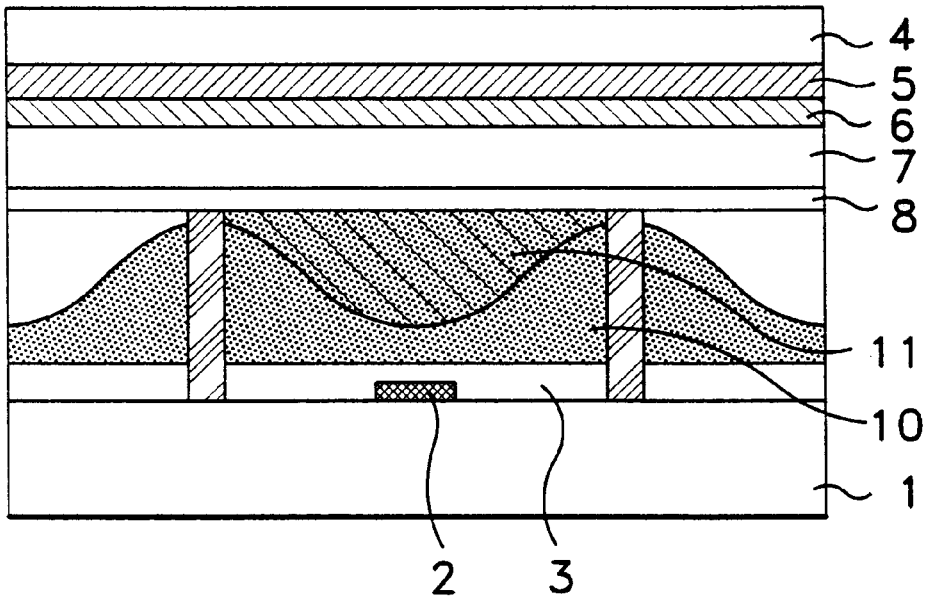
FIG. 1 Prior Art
FIG. 1 shows schematically a partial cross-sectional view of a conventional surface discharge plasma display panel.
Figure 2:
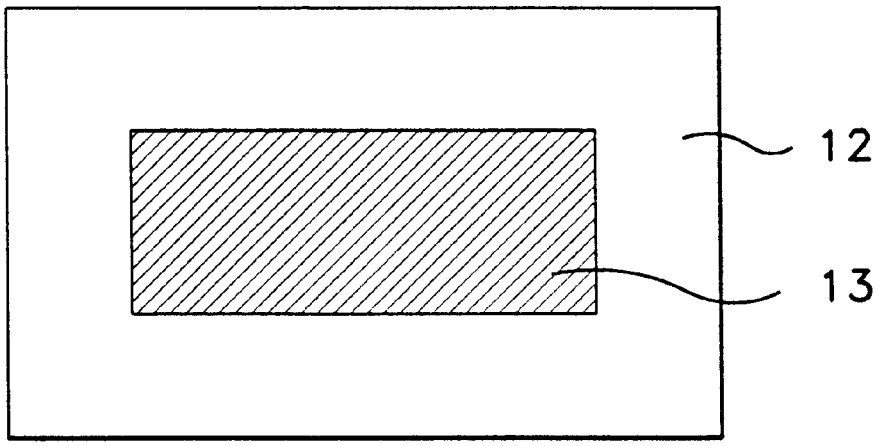
FIG. 2 Prior Art
FIG. 2 shows a plan view of the plasma display panel in FIG. 1, in which a discharge cell is divided into a displaying area and a non-displaying area.
Figure 3A:
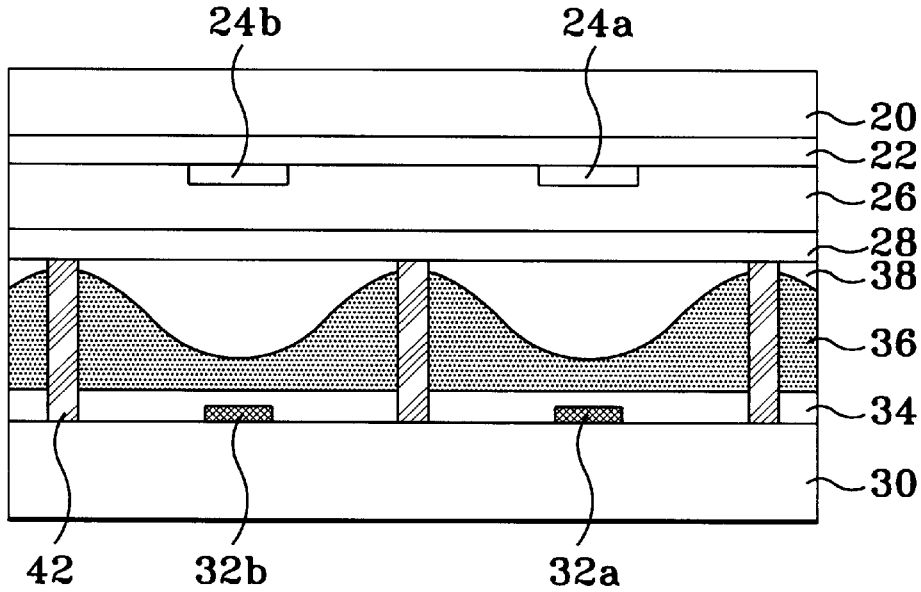
FIG. 3A shows schematically a partial cross-sectional view of a surface discharge plasma display panel according to one embodiment of the present invention.
Figure 3B:
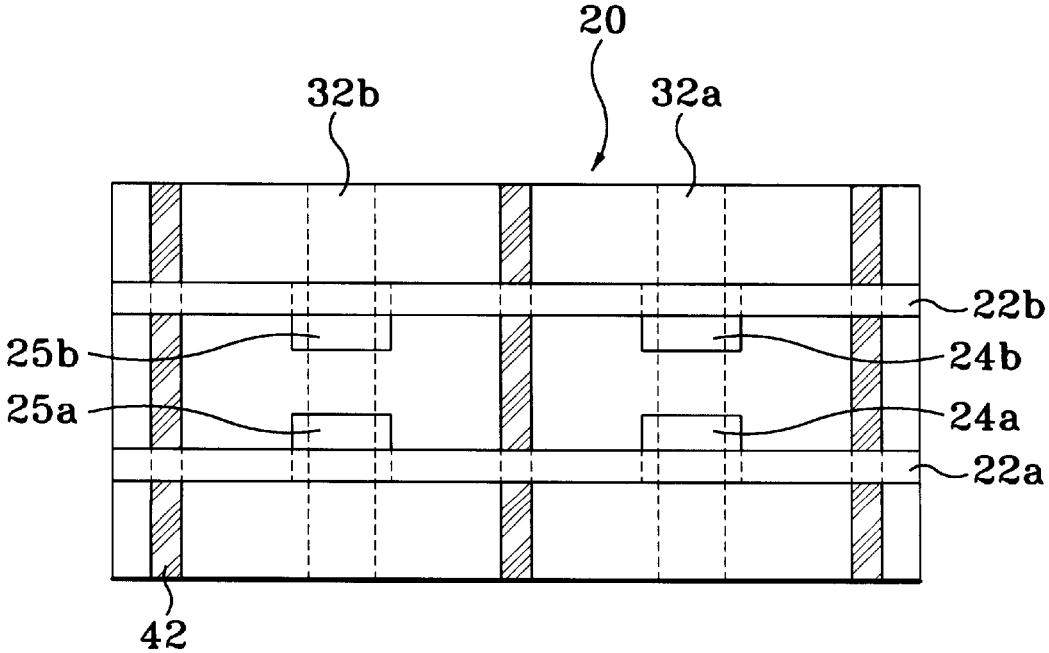
FIG. 3B shows a plan view of FIG. 3A.

FIG. 3A is a partial cross-sectional view of an alternating-current PDP, and FIG. 3B is a plan view of FIG. 3A, which shows two unit cell areas.

Referring to FIGS. 3A and 3B, a first or front substrate 20 and a second or rear substrate 30 which are provided with each inner face are arranged so that their inner faces are opposite to each other. Between the first and second substrates, a plurality of barrier ribs 42 are arranged toward a first direction. First electrodes or data bus lines 22*a*, 22*b* are arranged on the inner face of the first substrate 20 toward a second direction which is orthogonal with the first direction. Here, a unit cell is defined as an area which is limited by the barrier ribs 42 and includes a pair of first electrodes 22*a*, 22*b*. The pair of first electrodes 22*a*, 22*b* in each of the unit cells are respectively connected with each second electrode 24*a* and 24*b*, 25*a* and 25*b*. The second electrode comprises dot type first transparent electrodes 24*a*, 25*a* which are connected with the first electrode 22*a* in one side and directed to the first electrode 22*b* in the other side, and dot type second transparent electrodes 24*b*, 25*b* which are reversely connected with the first electrode 22*b* in one side and directed to the first electrode 22*a* in the other side.

On the inner face of the second substrate 30 between the barrier ribs 42, third electrodes or address electrodes 32*a*, 32*b*, which have respectively a first width and are arranged parallel with each other along the first direction, are located so that one third electrode is arranged in each of the cells. A dielectric film 34 is coated on the upper portion of the second substrate 30 including the third electrodes 32*a*, 32*b*. A reference number 26 is a dielectric layer, and 28 is a protective layer, and 36 is a fluorescent material which is selected out of red, blue, green ones so as to be capable of materializing colors, and 38 is a discharge space in the unit cell. The discharge space 38 is filled with a gas such neon or xenon.

Referring to FIGS. 3A and 3B, the driving system of the above mentioned AC PDP will be explained.

Generally, the driving of the PDP comprises a reset discharge step for resetting all of the cells, an addressing discharge step for selecting only a certain cell, and a sustain discharge step for keeping the discharging operation in the selected cell for a given time to display a desired image. Such steps are performed repeatedly. In the reset discharge, a high voltage is applied to one (hereinafter, referred to X electrode) of the first electrodes 22*a*, 22*b* so that an initial discharge is started. Thus, the discharging gas filled in the cell is ionized. Then, after starting the initial discharge, all of the cells are stabilized. Namely, a certain voltage is applied to the other one (hereinafter, referred to Y electrode) of the first electrodes 22*a*, 22*b* so that wall discharges generated in the cells are eliminated, and ions are neutralized. Therefore, all of the cells are reset to the off state.

In the addressing discharge, according as a data for displaying an image is inputted into the third electrode 32 and Y electrode, the wall discharges are formed in the selected cells.

And in the sustain discharge, a certain pulse is supplied to the X and Y electrode so that only the selected cells, in which the wall discharges are formed, can be discharged. Thus, the desired image can be displayed on the first substrate 20.

Here, since the transparent electrodes 24*a*, 24*b*, 25*a*, 25*b* are formed only in a displaying area, the wall discharged are not formed in a non-displaying area. Therefore, since the discharging operation is generated only in the displaying area during the addressing discharge, contrast ratio is progressed. Furthermore, because the discharging operation in the non-displaying area is prevented, power consumption can be reduced.

Figure 4A:
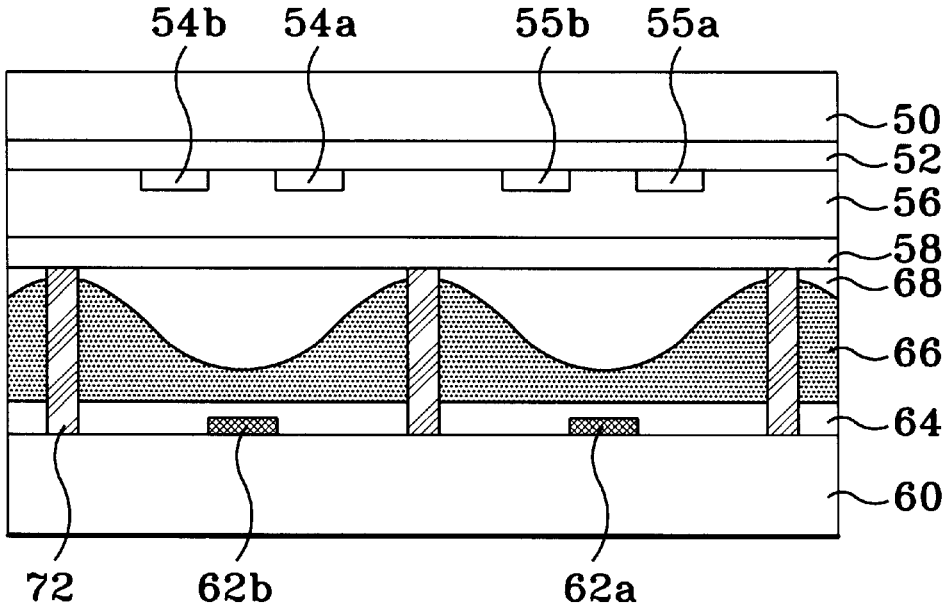
FIG. 4A shows schematically a partial cross-sectional view of a surface discharge plasma display panel according to other embodiment of the present invention.
Figure 4B:
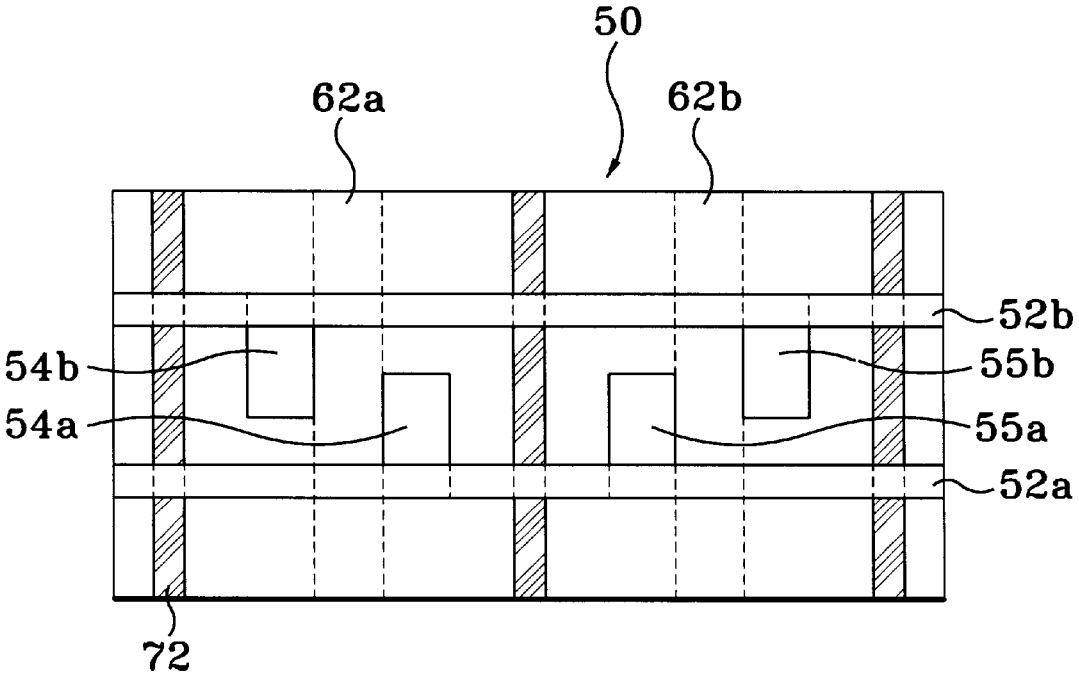
FIG. 4B shows a plan view of FIG. 4A.

FIGS. 4A and 4B show a cross-sectional view and a plan view of the surface discharge PDP according to the other embodiment of the present invention, and show a modified embodiment.

Referring to FIGS. 4A and 4B, dot type transparent electrodes 54*a* and 54*b*, 55*a* and 55*b*, each of which is connected electrically with first electrodes or data bus electrodes 52*a*, 52*b* parallel with each other in order to increase the discharging effect, are arranged to be crossed in a discharging cell. Here, the transparent electrodes 54*a*, 54*b*, 55*a*, 55*b* have a rectangular structure in which the length of the transparent electrodes parallel with a first direction is longer than the wide of the transparent electrodes parallel with a second direction so as to be capable of keeping the discharging operation for a given time.

In this embodiment, since the discharging operation is not generated in the edge of the cell adjacent to barrier rib 72, as disclosed in FIGS. 3A and 3B, contrast ratio can be progressed.

Although the preferred embodiment of this invention has been disclosed for illustrative purpose, those skilled in the art will appreciate that various modifications, additions and substitutions are possible, without departing from the scope and spirit of the invention as described in the accompanying claims.

What is claimed is:

1. A plasma display panel comprising:

a first substrate and a second substrate, each of which includes an opposing inner face;

a pair of barrier ribs separated from one another by a predetermined space and arranged along a first direction between said inner faces of said first and second substrates;

a pair of first electrodes arranged on said inner face of said first substrate along a second direction which is substantially orthogonal with respect to said first direction;

a unit cell defined by said barrier ribs and including portions of said first electrodes, said unit cell including a displaying area formed between said first electrodes;

a pair of second electrodes formed on said inner face of said first substrate and positioned within said unit cell, one of said second electrodes being connected to one of the said first electrodes and projecting into said displaying area, the other of said second electrodes being connected to the other of said first electrodes and projecting into said displaying area; and a third electrode which is arranged along said first direction between said barrier ribs and positioned on said inner face of said second substrate.

2. The plasma display panel as claimed in claim 1, wherein said second electrodes are arranged opposite to each other with a predetermined space.

3. The plasma display panel as claimed in claim 1, wherein said second electrodes are arranged to be crossed with respect to each other.

4. The plasma display panel as claimed in claim 3, wherein each of said second electrodes has a rectangular structure in which its length parallel to said first direction is longer than its width parallel to said second direction.

5. A plasma display panel comprising:

a first substrate and a second substrate, each of which includes an opposing inner face;

barrier ribs which are separated from one another by a predetermined space and arranged along a first direction;

a pair of first electrodes which are arranged on said inner face of said first substrate along a second direction orthogonal with respect to said first direction;

a dot type second electrode which is formed on said inner face of said first substrate and connected with said pair of first electrodes, said dot type second electrode projecting into a space between said pair of first electrodes; and a third electrode which is arranged along said first direction between said barrier ribs on said inner face of said second substrate;

wherein a unit cell is defined as an area which is limited by said barrier ribs and includes said pair of first electrodes, said dot type second electrode including two second electrodes formed within said unit cell and arranged opposite to each other with a predetermined distance.

6. A plasma display panel comprising:

a first substrate and a second substrate, each of which includes an opposing inner face;

barrier ribs which are separated from one another by a predetermined space and arranged along a first direction;

a pair of first electrodes which are arranged on said inner face of said first substrate along a second direction orthogonal with respect to said first direction;

a dot type second electrode which is formed on said inner face of said first substrate and connected with said pair of first electrodes, said dot type second electrode projecting into a space between said pair of first electrodes; and a third electrode which is arranged along said first direction between said barrier ribs on said inner face of said second substrate;

wherein a unit cell is defined as an area which is limited by said barrier ribs and includes said pair of first electrodes, said dot type second electrode including two second electrodes formed within said unit cell and arranged to be crossed with respect to each other.

7. The plasma display panel as claimed in claim 6, wherein each of said two second electrodes has a rectangular structure in which its length parallel to said first direction is longer than its width parallel to said second direction.

* * * * *